US005425857A

United States Patent [19]

Bouard et al.

[11] Patent Number: 5,425,857

[45] Date of Patent: Jun. 20, 1995

[54] PROCESS AND DEVICE FOR THE ELECTROLYTIC GENERATION OF ARSINE

[75] Inventors: Pascal Bouard, Draveil; Philippe Labrune, Saint Maur; Panayotis Cocolios, Le Chesnay, all of France

[73] Assignee: L'Air Liquide, Societe Anonyme Pour L'etude et L'Exploitation des Procedes Georges Claude, France

[21] Appl. No.: 305,835

[22] Filed: Sep. 14, 1994

[30] Foreign Application Priority Data

Sep. 17, 1993 [FR] France ..... 93 11082

[51] Int. Cl.[6] ..... C25B 1/02; C25B 9/00

[52] U.S. Cl. ..... 204/101; 204/103; 204/252; 204/263; 204/264; 204/275; 204/276

[58] Field of Search ..... 204/101, 103, 252, 263, 204/264, 265, 266, 275, 276, 277, 278

[56] References Cited

U.S. PATENT DOCUMENTS 4,178,224 12/1979 Porter ..... 204/232
5,158,656 10/1992 Ayers ..... 204/101

FOREIGN PATENT DOCUMENTS 962335 10/1982 U.S.S.R. .

OTHER PUBLICATIONS

V. P. Gladyshev, "Products of the Electrolytic Reduction of Arsenic (III) Compounds on a Lead Cathode," (1980) Abstract Only no month.

*Primary Examiner*—John Niebling
*Assistant Examiner*—Arun S. Phasge
*Attorney, Agent, or Firm*—Burns, Doane, Swecker & Mathis

[57] ABSTRACT

The invention relates to a process for the electrolytic generation of arsine from an electrochemical cell provided with a cathode supplied with $H^+$ and $AsO_2^-$ ions where two concurrent reactions take place producing arsine and gaseous hydrogen respectively, and an anode where a reaction producing $H^+$ ions takes place, the ratio of the $H^+/As$ concentrations at the cathode being controlled and kept constant.

26 Claims, 4 Drawing Sheets

PROCESS AND DEVICE FOR THE ELECTROLYTIC GENERATION OF ARSINE

BACKGROUND OF THE INVENTION (i) Field of the Invention

The invention relates to a process and a device for the electrolytic generation of arsine ($AsH_3$).

(ii) Description of Related Art

Gaseous hydrides play a key role in the semiconductor industry. Examples, therefore, are silane used as a precursor for the manufacture of silicon substrates or for the production of silica deposits, or even arsine used as a source of arsenic for the doping of semiconductors or for the growth of epitaxial layers of GaAsP.

The use of arsine does pose safety problems associated with the highly toxic nature of this gas, so that it has to be handled with extreme care (use of hoods) during the production, storage or even transportation thereof in the form of bottles containing a generally reduced concentration of arsine in a carrier gas.

It therefore appeared to be advantageous to perfect a method for the production (or generation) of arsine in situ (or on site) for producing arsine in situ at the inlet of the reactor using this hydride under good safety conditions and with high purity.

The electrolytic reduction of solutions containing arsenic salts rapidly appeared to be an effective solution to this problem.

The document U.S. Pat. No. 1,375,819 therefore proposes a process for the production of arsine by the electrolysis of a solution of an arsenic oxide (such as $As_2O_3$) in an acid medium (sulphuric acid) in which potassium sulphate ($K_2SO_4$) is also present. The electrolyser used is of the tank type, the cathode is made of carbon coated with mercury and the anode is made simply of carbon. The arrangement used results in the production of a gas which is is fact a mixture of oxygen, hydrogen and arsine. Although no precise composition is given for the mixture, it can be deduced in a simple manner from this arrangement that it does not separate the gases emitted at the cathode and at the anode, and that it does not prevent the $AsO_2^-$ ions present in solution from being oxidised at the anode, thereby reducing the arsine yield accordingly.

In this context, the document U.S. Pat. No. 4,178,224 (V. R. Porter) proposes an electrolytic system for the production of arsine base on the following principle. The electrolytic cell is again of the tank type, but is made up of two concentric compartments playing the role of electrodes. These two electrodes are separated in their upper part by a solid cylindrical barrier (which is also concentric around the anode), the aim of which is to separate the gases produced at the anode and the cathode before they are discharged via the upper part of the cell. This "upper" barrier is complemented by a "lower" barrier (also cylindrical and concentric around the anode) which may or may not be continuous with the preceding barrier, the aim of which is likewise to separate the gases produced at the bubble stage, but also to allow for the passage of the $H^+$ ions from the anode towards the cathode where they supply the arsine formation reaction. It is envisaged that this second barrier will be made of a material such as porous polypropylene or PVC, but in the latter case, a small window is provided in the lower part of the cell to allow for the passage of the $H^+$ ions. According to this document, these two barriers could be connected together to form one single solid barrier, but, once again, an opening must then be provided in the lower part to allow for the passage of the $H^+$ ions. The cathode is supplied with an acid solution ($H_2SO_4$) of $NaAsO_2$ injected between the anode and the cathode from a container exterior to the cell with the aid of a pump. Nevertheless, the results obtained show that the mixture produced at the cathode (Example 1) reaches only 20% of arsine in hydrogen in the steady state and not more than 38% at the maximum.

The document EP-A-393 897 can also be cited, once again proposing the electrolytic production of arsine. The electrolytic cell is of the tank type, containing an aqueous NaOH solution, the electrodes both consisting of arsenic. Although the arsenic yield given is high (approximately 97% in hydrogen), the throughput obtained, on the other hand, is very low (approximately 15 $cm^3/h$ at atmospheric pressure).

SUMMARY OF THE INVENTION

The aim of this invention is to propose a process for the electrolytic generation of arsine, by which means it is possible:

- to obtain high arsine concentrations in the outgoing gas;
- to obtain sufficiently high throughputs at least equal to 1 liter/hour without reducing the arsine yield;
- to obtain good stability of the concentration properties of the mixture produced, and
- to avoid the use of sodium salts (such as $NaAsO_2$) as a raw material so as to prevent the precipitation of salts such as $Na_2SO_4$ and thus the risk of the possible presence of sodium in the gaseous phase, this still being detrimental to subsequent applications in the electronics industry.

To this end, the invention proposes a process for the electrolytic generation of arsine from an electrochemical cell provided with a cathode supplied with $H^+$ and $AsO_2^-$ ions where two concurrent reactions take place producing arsine and gaseous hydrogen respectively, and an anode where a reaction producing $H^+$ ions takes place, in which the ratio of the $H^+/As$ concentrations at the cathode is controlled and kept constant.

DETAILED DESCRIPTION OF PREFERRED EMBODIMENTS

Figure 1:
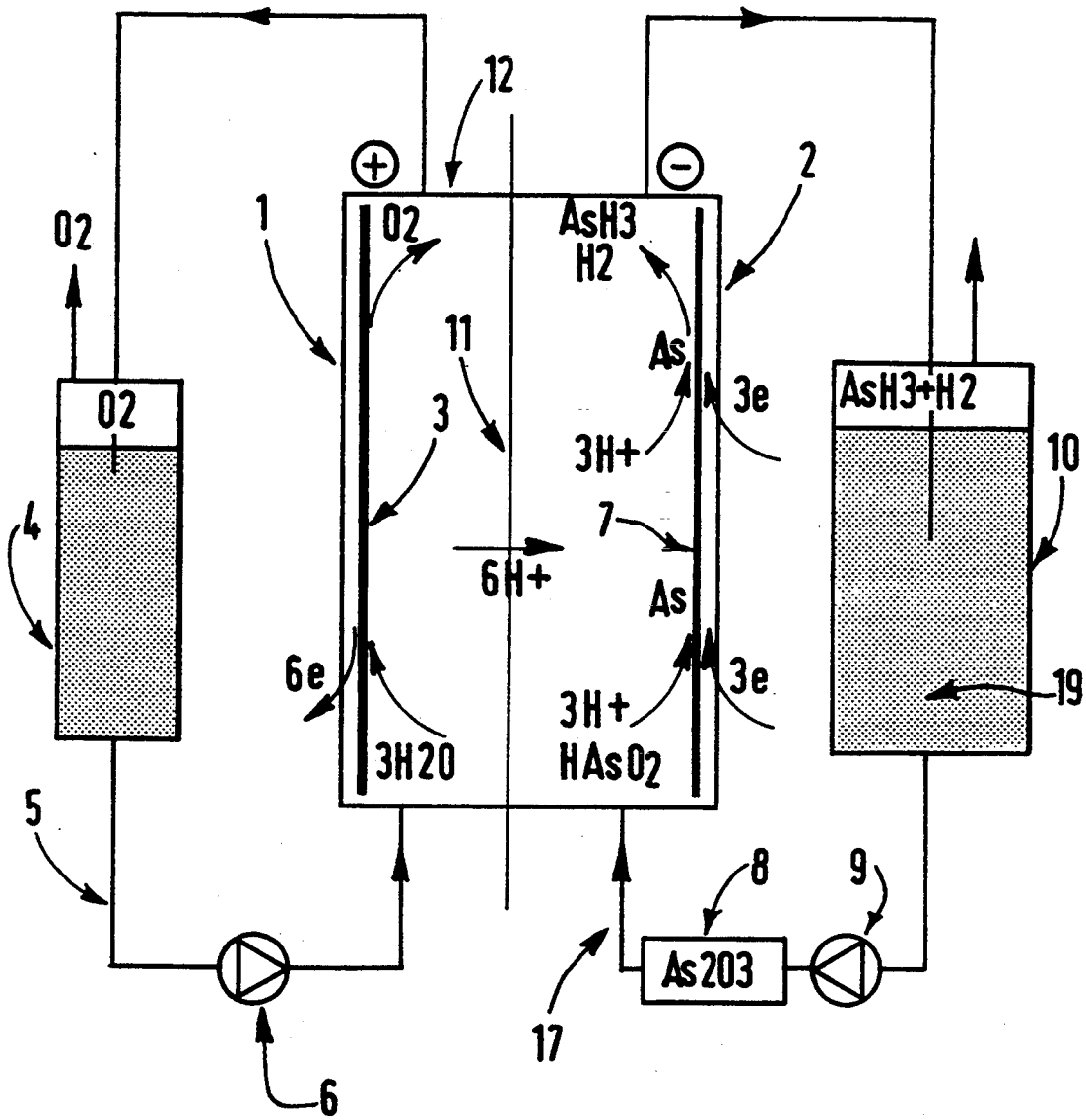
FIG. 1 is a diagrammatic view of an electrolytic cell forming part of a generator suitable for carrying out the process according to the invention.

The reaction producing $H^+$ ions can consist of, e.g. the electrolysis of water (in the case of a conventional flat anode supplied with an acid solution) or even the oxidation of hydrogen (a gaseous diffusion electrode supplied with gaseous hydrogen). As this second type of electrode has a very large specific surface area, catalyst particles (of the platinum type) are generally present at the gas/liquid interface, on which the hydrogen is oxidised to form $H^+$ ions and is treated at the gas side so that it becomes hydrophobic.

The Applicant has in fact illustrated the key role of the $H^+/As$ ratio at the cathode, and its influence on the arsine yield obtained (arsine concentration in the gaseous mixture obtained at the cathode). Each cell shape has a corresponding optimum $H^+/As$ ratio to be observed and maintained.

According to one feature of the invention, the $H^+/As$ ratio is controlled by the following stages:

- the electrochemical cell is divided into two compartments, i.e. an anode compartment and a cathode compartment, by means of a cationic membrane, thereby allowing for control of the material streams in the interior of the cell;
- the fluid supplying the cathode compartment is circulated to a sufficient extent to obtain an arsenic conversion rate at the cathode of less than 10%, and
- the cathode compartment is supplied with $H^+$ and $AsO_2^-$ ions via a saturator consisting of an $As_2O_3$ solid compound reserve swept by an acid solution.

The phrase "conversion rate" as used according to the invention refers to the ratio: $(As^e-As^s)/As^e$, where $As^e$ is the arsenic concentration in the fluid supplying the cathode compartment and $As^s$ is this same concentration in the outgoing fluid which is recycled towards the storage tank supplying the cathode compartment.

The balance of the chemical reactions taking place at the anode and the cathode is as follows:

At the saturator:

$As_2O_3+H_2O \rightarrow 2HAsO_2$

At the anode:

$H_2O \rightarrow 1/2O_2+2H^++2e$ ($H_2 \rightarrow 2e$ for a gaseous diffusion electrode)

At the cathode:

$HAsO_2+3H^++3e \rightarrow As+2H_2O$ $As+3H^++3e \rightarrow AsH_3$ concurrent reaction at the cathode: $H^++1e \rightarrow \frac{1}{2}2$ According to one of the embodiments of the invention, the $As_2O_3$ reserve (saturator) is located in the circuit between the cathode compartment and the storage tank for the acid solution which sweeps the saturator.

According to another embodiment of the invention, the $As_2O_3$ reserve (saturator) is located in the circuit in the interior of the storage tank for the acid solution, within this solution, thereby ensuring close contact between this solution and the walls of the saturator.

The phrase "cationic membrane" as used according to the invention refers to an ion exchange membrane by which means it is possible:

- to allow the $H^+$ ions produced at the anode to pass on to the cathode, where they will supply the arsine formation reaction;
- to separate the gases produced at the anode from those produced at the cathode;
- to prevent the $AsO_2^-$ ions in solution at the cathode compartment side from passing on to the anode side and oxidising at the anode, thereby reducing the arsine yield accordingly.

A material such as the one sold under the name NAFION$^R$ is suitable for making a membrane of this kind.

The use of the $As_2O_3$ saturator prevents the need to use sodium salts, but also forms a sort of buffer tank which ensures a regular, constant concentration of $AsO_2^-$ ions in the medium supplying the cathode.

The acid medium forming part of the composition of the mixtures supplying the two compartments may include phosphoric acid, perchloric acid or preferably sulphuric acid.

The electrodes used to carry out the invention are advantageously formed as follows: at the cathode, a material promoting the formation of arsine at the expense of the concurrent hydrogen formation reaction, advantageously a material such as copper coated with bismuth, lead or even thallium or cadmium, with an electrode surface area of approximately 70 $cm^2$. A material such as titanium coated with ruthenium or iridium oxide, or an electrode, e.g. of the carbon felt type, will be used at the anode as the case may be (conventional electrolysis or gas electrode).

The $H^+/As$ ratio established and kept constant in this manner:

- by virtue of the use of suitable electrodes,
- by the use of a cationic membrane disposed between the two electrodes allowing for effective control of the material streams from one electrode to the other,
- by a regular, constant supply of $AsO_2^-$ ions with the aid of an $As_2O_3$ saturator, and
- by establishing a high fluid circulation rate allowing for effective control of the conversion rate at the cathode, is closely connected to the geometry of the cell used (electrode surface area). Each shape has a corresponding optimum $H^+/As$ ratio. However, according to this invention, this ratio will advantageously be maintained within the range [0.7, 1.5], preferably within the range [0.75, 1.25].

According to one feature of the invention, a stage for separating the hydrogen/arsine mixture produced at the cathode is effected downstream of the generator, this mixture being treated by means of a membrane module so as to obtain a higher arsine concentration at the module outlet (or discharge) than in the arsine/hydrogen mixture treated at the inlet of the module, but also so as to obtain high stability of this concentration.

An assembly of one or more semi-permeable membranes mounted in series or in parallel and having good properties for separating arsine with respect to a carrier gas (selectivity) will advantageously be used to effect this concentration stage, as is the case for membranes of the polyimide or even of the polyaramide (aromatic polyimide) type.

According to one of the embodiments of the invention, if the mixture arrives at the module at low pressure, this low pressure is compensated for by pumping out or even by sweeping with the aid of a "tool" gas at the permeate side of the membrane, so as to reduce the partial pressure of the hydrogen (which it is desired to separate from the arsine) at the permeate side.

The phrase "low pressure" as used according to the invention refers to a pressure within the range $10^4$ Pa to $5\times10^5$ Pa absolute.

In order to effect sweeping at the permeate side of the membrane, the gas used is preferably different from the one it is desired to separate and moreover exhibits slight permeation of the permeate towards the interior of the membrane so as to prevent this "tool" gas from polluting the interior of the membrane and thus affecting the result obtained at the module outlet. According to the invention, nitrogen or even $SF_6$ is advantageously used as the "tool" gas.

According to one of the features of the invention, before it arrives at the membrane module, the mixture produced at the cathode is subjected to at least one drying operation by means of a device such as a cooler (e.g. a Peltier-effect cooler) or even a molecular sieve, or a combination of these two means, and, if necessary, at least one filtering operation by means of a particle filter.

Another aim of the invention is to propose a device for carrying out the process according to the invention.

The device comprises at least an electrochemical cell provided with at least one cathode supplied with $H^+$ and $AsO_2^-$ ions where two concurrent reactions take place producing arsine and gaseous hydrogen respectively, and at least one anode where a reaction producing $H^+$ ions takes place, a cationic membrane dividing the electrochemical cell into two compartments, i.e. an anode compartment and a cathode compartment, and, in order to supply the cathode compartment with $H^+$ and $AsO_2^-$ ions, a saturator consisting of an $As_2O_3$ reserve swept by an acid solution.

According to one of the embodiments of the invention, the reaction producing $H^+$ ions at the anode is the electrolysis of water, the anode compartment then being supplied with an acid solution. According to another embodiment of the invention, the reaction producing $H^+$ ions at the anode is the oxidation of hydrogen, this being in the presence of a gaseous diffusion electrode supplied with gaseous hydrogen.

According to one of the features of the invention, the saturator is situated between the electrochemical cell and the storage tank for the acid solution supplying the cathode compartment.

According to another feature of the invention, the saturator is situated in the interior of the storage tank for the acid solution supplying the cathode compartment, within this acid solution.

The cathode will preferably be made of a material promoting the arsine formation reaction at the expense of the hydrogen formation reaction, such as copper coated with bismuth, lead, or even thallium or cadmium. A material such as titanium coated with ruthenium or iridium oxide, or an electrode, e.g. of the carbon felt type, will be used at the anode as the case may be (conventional electrolysis or gas electrode).

According to one of the features of the invention, the device includes, downstream of the electrochemical cell, a membrane module by means of which the arsine/hydrogen mixture produced at the cathode is subjected to a separation stage so as to obtain a higher arsine concentration at the module outlet than in the initial mixture.

According to one of the embodiments of the invention, the membrane module is connected to means for pumping out the permeate side of the-membrane so as to bring the pressure at the permeate side to a value of approximately 1 to 100 Pa (first stage vacuum).

According to another embodiment of the invention, the membrane module is connected to a gas source so that the permeate side of the membrane can be swept with the aid of this gas, which, according to the invention, advantageously exhibits slight permeation of the permeate towards the interior of the membrane, such as nitrogen or $SF_6$.

According to one of the features of the invention, the device comprises, upstream of the membrane module, at least one device for drying the mixture produced at the cathode, such as a cooler, e.g. a Peltier-effect cooler, or even a molecular sieve, or a combination of these two means, and, if necessary, at least one particle filter.

Other features and advantages of this invention will be clear from the following description of embodiments given purely by way of non-limiting examples and with reference to the accompanying drawings, in which:

FIG. 1 shows an electrochemical cell 12 consisting of:

- an anode compartment 1 connected to the positive pole of an electric generator including an anode 3 where a reaction for the oxidation of water takes place, leading to the formation of gaseous oxygen and $H^+$ ions. This anode is made of titanium coated with ruthenium oxide. The anode compartment is supplied with a 1M sulphuric acid solution contained in an anode storage tank 4 via a supply line 5 by means of a pump 6;
- a cathode compartment 2 connected to the negative pole of an electric generator including a cathode 7 where two concurrent reactions take place, the first for the formation of gaseous arsine and the second for the formation of gaseous hydrogen. This cathode is made of lead and it has an electrode surface area of approximately 70 $cm^2$. The cathode compartment is supplied with an $HAsO_2$ compound, i.e. with $AsO_2^-$ ions, by means of a line 17, via a saturator 8 consisting of an $As_2O_3$ solid compound reserve swept with the aid of a pump 9 by a 1M sulphuric acid solution 19 contained in a cathode storage tank 10, and
- a cationic membrane 11 made of NAFION$^R$ separating the two compartments.

Figure 2:
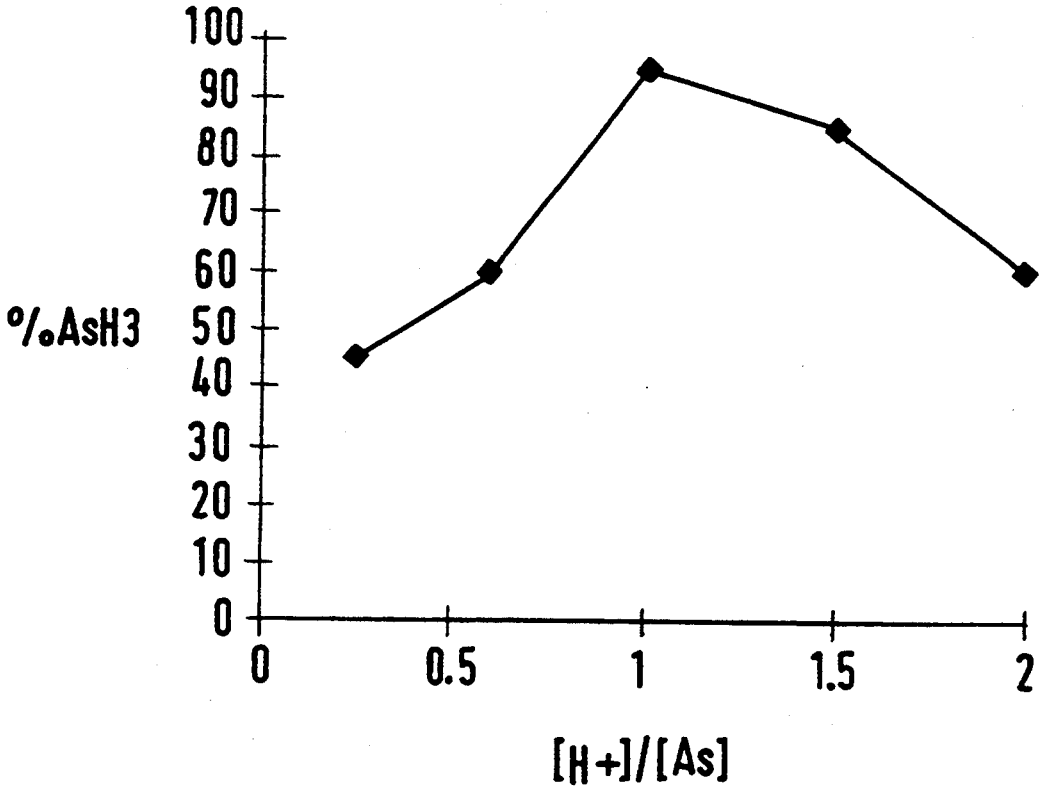
FIG. 2 is a graph showing the variation of the arsine concentration in the mixture produced as a function of the $H^+/As$ ratio at the cathode, made of lead, and for a current density $i \simeq 500$ $A/m^2$ for a cell according to FIG. 1.

FIG. 2 shows the performances obtained with the aid of a generator such as the one described hereinabove, using a current density (with respect to the electrode surface area) of 500 $A/m^2$. The development observed confirms the existence of an optimum value for the $H^+/As$ ratio, close to 1 for this cell geometry, resulting in the production of an arsine/hydrogen mixture containing 95% arsine at the cathode, with a throughput of 50 $l/h/m^2$ ($m^2$ of electrode). The performances decrease rapidly around the optimum value.

Figure 3:
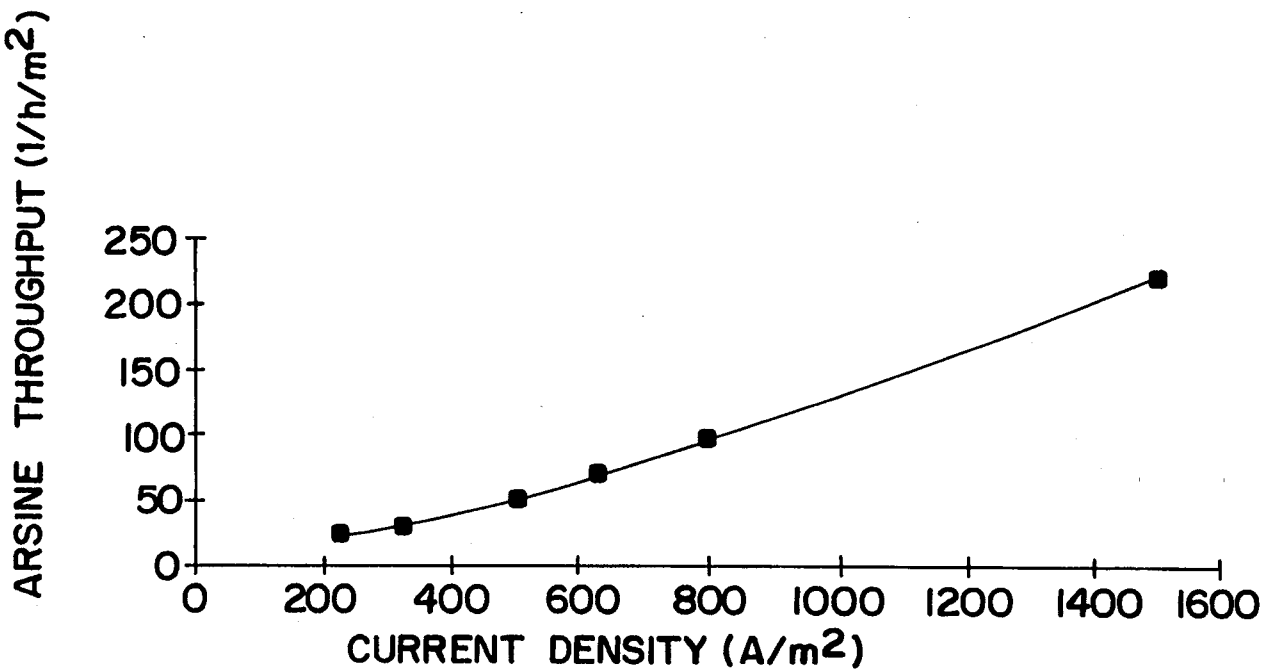
FIG. 3 is a graph showing the influence of the current density (with respect to the electrode surface area) on the arsine throughput at the cathode for a cell according to FIG. 1.

FIG. 3 shows the influence of the current density on the arsine throughput produced at the cathode 7 under these same cell and electrode conditions, for an $H^+/As$ ratio of close to 1. An increasing arsine throughput of approximately 25 $l/h/m^2$ to approximately 225 $l/h/m^2$ will be noted in the current density range [200 $A/m^2$, 1500 $A/m^2$].

Figure 4:
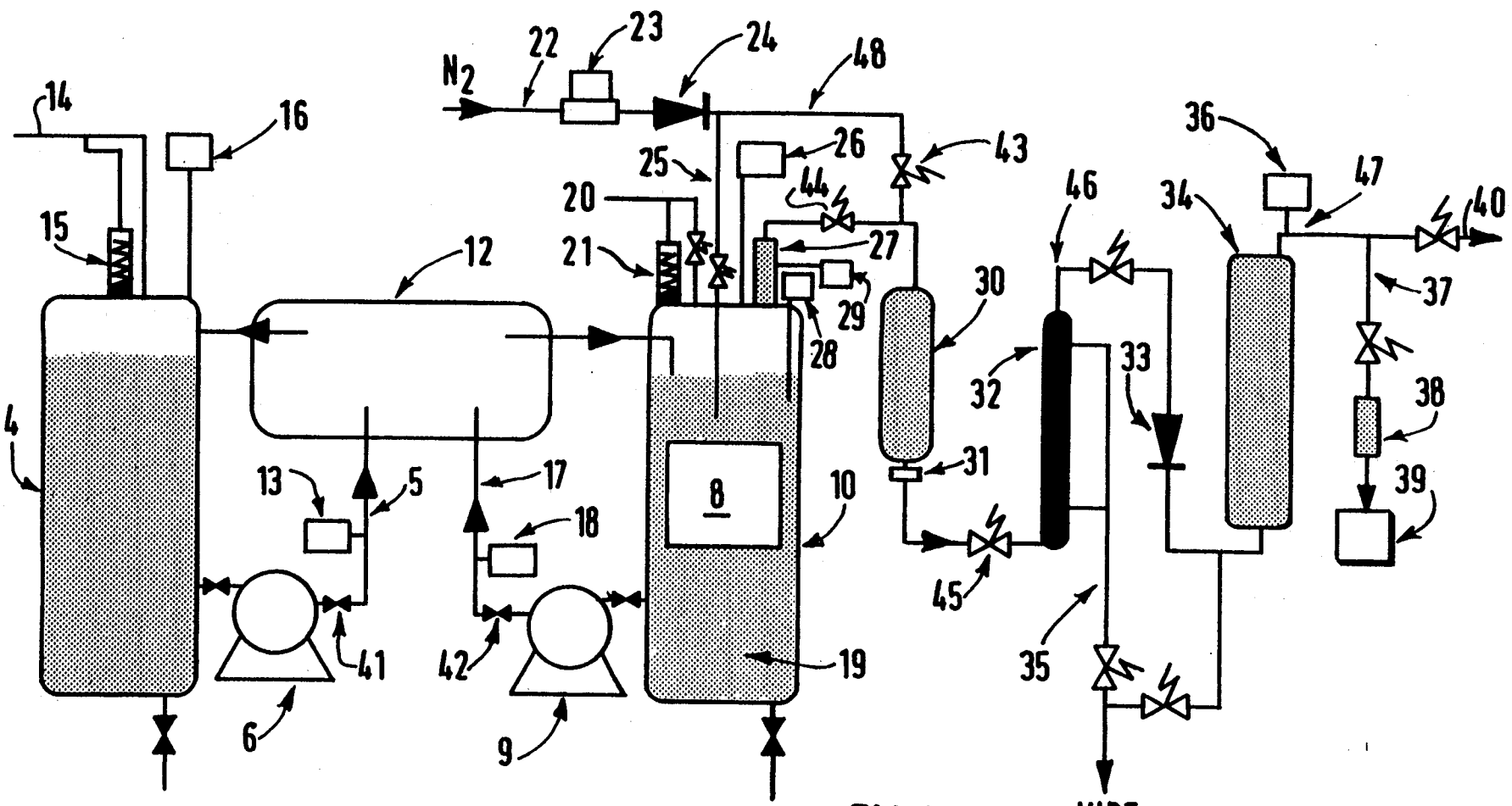
FIG. 4 is a diagrammatic view of a complete installation comprising a generator suitable for carrying out the process according to the invention.

FIG. 4 shows an electrochemical cell 12 such as the one described with reference to FIG. 1.

At the anode side, the compartment of the cell 12 is supplied with an acid solution stored in the tank 4, via the line 5 which in this case moreover incorporates a throughput sensor 13. The tank 4 includes means for the discharge of the oxygen produced at the anode towards a vent 14, via a valve 15 if necessary, and a pressure sensor 16.

At the cathode side, the compartment of the cell 12 is supplied with $AsO_2^-$ ions by means of the storage tank 10, via the line 17 which comprises a throughput sensor 18. The $As_2O_3$ reserve (saturator 8) is here included in the storage tank 10, within the acid liquid 19, and is swept continuously by the latter so that the $As_2O_3$ compound can be dissolved continuously in the solution, so that it is saturated with $AsO_2^-$ ions.

The cathode tank 10 includes means for discharging the gas towards a vent 20, via a valve 21 if necessary. This discharge is used in particular during operations for purging the system.

It will also be noted that an inlet 22 for inert gas (such as nitrogen) is provided on the top of the tank 10, passing via a flow meter 23 and a non-return valve 24 in order to supply the tank 10 with nitrogen via an inlet line 25. This inflow of nitrogen is used in particular to effect the cycles for purging the storage tank when the installation is started up, but also for purging the downstream part of the installation via a line 48 branching off from the line 25.

The tank 10 also includes a pressure sensor 26 and a temperature sensor 28.

The arsine/hydrogen mixture produced at the cathode of the cell 12 is first of all treated by means of a cooler 27 (the temperature of which is controlled by means of a sensor 29) so as to remove a large part of the moisture from the mixture in question.

At the outlet of the cooler 27, via a valve 44, the mixture is subjected to a second operation for the removal of water by means of a molecular sieve 30 before passing on to a particle filter 31. The mixture then contacts a semi-permeable membrane module 32 of the hollow fibre type, the active layer of which is a polyaramide (aromatic polyimide) offering a total exchange surface area for the module of approximately 0.25 $m^2$.

The installation allows the permeate side of the membrane to be pumped out via a line 35 at a pressure of approximately 10 Pa absolute (first stage vacuum).

The mixture enriched with arsine at the membrane outlet (discharge) is then advanced via a line 46 comprising a non-return valve 33 towards a buffer tank 34, from where the mixture is advanced via a line 47 comprising a pressure sensor 36 towards the reactor 39 using arsine. During its passage, the mixture may be filtered by means of a particle filter 38. A vent 40 is provided if necessary at the end of the line 47.

Valves of two types are provided all along the path, depending on the fluids conveyed, valves for the liquid circuit (such as the valves 41, 42, etc.) and valves for the gas circuit (such as the valves 43, 44, 45, etc.).

The application of this installation has made it possible to obtain arsine concentrations in hydrogen at the outlet of the cathode compartment varying from 50% to 95% according to the $H^+/As$ ratio used (as shown in FIG. 2), with a throughput of the mixture at the cell outlet of at least 3 l/h. The drying stage formed by the cooler 27 and a molecular sieve 30 makes it possible to obtain a mixture almost free of water, and additional drying can be effected by means of the membrane 30. The essential aim of the membrane is to concentrate the arsine in the mixture obtained at the membrane outlet. The tests carried out have shown that, starting from very variable mixtures such as those mentioned hereinabove, it was possible to concentrate the arsine mixture at the membrane outlet to a content of at least 99.5% in hydrogen, with throughputs at the membrane outlet of approximately 1 l/h pure arsine (the throughput of the mixture at 99.5 being slightly higher). The use of a membrane post-concentration stage allows for accuracy of approximately 0.1% with respect to the arsine content produced, but also for excellent stability of this concentration over time.

We claim:

1. A process for electrolytically generating arsine from an electrochemical cell comprising a cathode and an anode comprising the steps of:

(i) supplying $H^+$ and $AsO_2^-$ to said cathode such that two concurrent reactions take place producing arsine and gaseous hydrogen, respectively, wherein the $H^+$ and $AsO_2^-$ are present in a ratio of $H^+/As$ which is controlled and kept constant;

(ii) carrying out a reaction producing $H^+$ ions at said cathode.

2. Process according to claim 1 further comprising controlling the $H^+/As$ ratio by the following stages:

a) dividing the electrochemical cell into an anode compartment and a cathode compartment, with the aid of a cationic membrane, thereby allowing for control of material streams in the cell;

b) circulating a fluid supplying the cathode compartment to a sufficient extent to obtain an arsenic conversion rate at the cathode of less than 10%, and c) supplying the cathode compartment with $H^+$ and $As_2O^-$ ions by means of an $As_2O_3$ reserve swept by an acid solution.

3. Process for the electrolytic generation of arsine according to claim 1 wherein the cathode is made of a material promoting the arsine producing reaction at the expense of the hydrogen producing reaction.

4. Process according to claim 3 wherein the cathode is made of lead, or copper coated with bismuth, lead, thallium or cadmium.

5. Process according to claim 1 wherein the $H^+/As$ ratio is kept between 0.7 and 1.5.

6. Process according to claim 5 wherein the $H^+/As$ ratio is kept between 0.75 and 1.25.

7. Process according to claim 1, further comprising subjecting the mixture of hydrogen and arsine produced at the cathode to a subsequent separation stage by a membrane module so as to obtain a higher arsine concentration at a module outlet than in said mixture.

8. Process according to claim 7 further comprising pumping out a permeate side of the membrane module.

9. Process according to claim 7 further comprising effecting sweeping at the permeate side of the membrane module with the aid of a gas exhibiting slight permeation of permeate towards an interior of the membrane.

10. Process according to claim 9 wherein said gas is nitrogen or $SF_6$.

11. Process according to claim 7 further comprising subjecting the mixture produced at the cathode, before said mixture arrives at the membrane module to at least one drying operation.

12. Process according to claim 11 wherein said drying operation is carried out by means of a Peltier-effect cooler, a molecular sieve, or a combination thereof.

13. Process according to claim 11 further comprising subjecting the mixture produced at the cathode to at least one filtering operation by means of a particle filter.

14. Device for electrolytic generation of arsine, suitable for carrying out the process according to claim 1, comprising:

an electrochemical cell provided with a cathode supplied with $H^+$ and $AsO_2^-$ ions where two concurrent reactions take place producing a mixture of arsine and gaseous hydrogen respectively, and an anode where a reaction producing $H^+$ ions takes place;

a cationic membrane dividing the electrochemical cell into an anode compartment and a cathode compartment, and means for supplying the cathode compartment with $H^+$ and $AsO_2^-$ ions, including a saturator comprising an $As_2O_3$ reserve swept by an acid solution.

15. Device according to claim 14 wherein the saturator is situated between the electrochemical cell and a storage tank for the acid solution supplying the cathode compartment.

16. Device according to claim 14 wherein the saturator is situated in an interior of the storage tank for the acid solution supplying the cathode compartment, within said acid solution.

17. Device according to claim 14 wherein the cathode is made of a material promoting the arsine producing reaction at the expense of the hydrogen producing reaction.

18. Device according to claim 17 wherein the cathode is made of lead, or copper coated with bismuth, lead, thallium or cadmium.

19. Device according to claim 14 further comprising, downstream of the electrochemical cell, a membrane module by means of which the arsine/hydrogen mixture produced at the cathode is subjected to a separation stage so as to obtain a higher arsine concentration at a module outlet than in said mixture.

20. Device according to claim 19 wherein the membrane module is connected to means for pumping out a permeate side of the membrane.

21. Device according to claim 19 wherein the membrane module is connected to a gas source so that the permeate side of the membrane can-be swept with aid of this gas which exhibits slight permeation of the permeate towards an interior of the membrane.

22. Device according to claim 21 wherein said gas is nitrogen or $SF_6$.

23. Device according to claim 19 further comprising, upstream of the membrane module, at least one device for drying the mixture produced at the cathode.

24. Device according to claim 23 further comprising at least one particle filter.

25. Device according to claim 14 wherein the anode compartment has a flat electrode supplied with an acid solution where electrolysis of water takes place.

26. Device according to claim 14 wherein the anode compartment has a gaseous diffusion electrode supplied with hydrogen where oxidation of hydrogen takes place.

* * * * *